US005626506A

United States Patent [19]

Halford et al.

[11] Patent Number: 5,626,506

[45] Date of Patent: May 6, 1997

[54] TOY VEHICLE HAVING CONCEALED EXTENDABLE JAWS

[75] Inventors: Wayne R. Halford, Hermosa Beach; Philip O. Riehlman, Redondo Beach, both of Calif.

[73] Assignee: Mattel, Inc., El Segundo, Calif.

[21] Appl. No.: 515,337

[22] Filed: Aug. 15, 1995

[51] Int. Cl.[6] ..... A63H 17/00

[52] U.S. Cl. ..... 446/465; 446/470; 446/486

[58] Field of Search ..... 446/431, 441, 446/465, 470, 486, 489

[56] References Cited

U.S. PATENT DOCUMENTS

| | | | |
|---|---|---|---|
| 3,748,780 | 7/1973 | Glass | 446/470 |
| 4,393,620 | 7/1983 | Murakami | 446/470 |
| 4,568,307 | 2/1986 | Gabler | 446/466 |
| 4,717,365 | 1/1988 | Andersen | 446/489 |
| 4,717,367 | 1/1988 | Stubenfoll | 446/441 |
| 4,762,511 | 8/1988 | Lee | 446/470 |

FOREIGN PATENT DOCUMENTS

| | | | |
|---|---|---|---|
| 491262 | 3/1953 | Canada | 446/441 |

*Primary Examiner*—Robert A. Hafer
*Assistant Examiner*—Jeffrey D. Carlson
*Attorney, Agent, or Firm*—Roy A. Ekstrand

[57] ABSTRACT

A toy vehicle includes a rear body having a rear chassis portion extending downwardly therefrom which supports a pair of rear wheels. A front chassis is pivotally secured to the rear chassis and extends forwardly therefrom supporting a pair of front wheels. The vehicle further includes a front body portion formed of a pair of pivotally coupled members commonly secured to an elongated rearwardly extending gear rack. A spoiler slidably supported within the rear body is coupled to a forwardly extending gear rack. A compound gear is rotatably supported within the rear body and engages each gear rack such that movement in the forward direction of the rear spoiler causes a multiplied distance movement of the gear rack supporting the front body portion. A resilient membrane partially encloses the gear racks and is stretched between the rear chassis and the front body portion. As the spoiler is forced forwardly against the rear body, the gear rack and gear coupling drives the pivotally coupled front body portion forwardly allowing it to assume an open mouth configuration and exposing a pair of simulated jaws. The resilient membrane stretches to accommodate the forward extension of the vehicle.

14 Claims, 2 Drawing Sheets

TOY VEHICLE HAVING CONCEALED EXTENDABLE JAWS

FIELD OF THE INVENTION

This invention relates generally to toy vehicles and particularly to those having alternative configurations.

BACKGROUND OF THE INVENTION

Toy vehicles have proven to be an extremely popular and long lasting toy category. Responding to the continued and ever increasing popularity of such toy vehicle products, practitioners in the art have endeavored to provide a virtually endless array of toy vehicle types. Such toy vehicles have been provided in both unpowered and powered versions. The former usually provides a plurality of rolling wheels upon which the user moves the toy vehicle. The latter typically provides a wind-up spring driven or battery-powered electric drive mechanism which transmits operative power to one or more of the rolling wheels. In addition, toy vehicles have been provided having inertial or flywheel type drive mechanisms. In addition to powered and unpowered variations of toy vehicles, a virtually unlimited array of vehicle appearances have been provided. Such toy vehicles have also been provided in featured versions or types as well as transformable toy vehicles. Featured toy vehicles refers to vehicles having some accessory capability or interactive accessory such as toy vehicles firing weapons, climbing, launching or firing missiles, spinning or turning, or remote control capability. Transformable toy vehicles, on the other hand, refers generally to toy vehicles which undergo dramatic appearance changes by providing a plurality of articulated elements which may be configured to provide distinct appearances. For example, transformable toy vehicles which may be reconfigured to form a robot or monster have become extremely plentiful in the art.

For example, U.S. Pat. Des. No. 305,050 issued to Ishizawa sets forth a RECONFIGURABLE DOUBLE-HEADED TOY FIGURE having a plurality of articulated elements which alternatively form a double-headed dragon-like monster or a futuristic robot.

U.S. Pat. No. 4,170,840 issued to Ogawa sets forth a TOY VEHICLE DOLL ASSEMBLY including an articulated doll and subcomponent parts capable of forming a vehicle. The doll may be configured to represent a humanoid with removable appendages and a front carriage member supporting a pair of wheels may be removably attached to the legs of the doll while a rear carriage member may be removably attached to the back of the doll body to form a toy vehicle.

U.S. Pat. No. 4,206,564 issued to Ogawa sets forth an ARTICULATED RECONFIGURABLE ROBOT DOLL formed of a plurality of diverse shaped pieces wherein each pair of pieces are joined together by a press fit joint. The pieces that make of the body and limbs of the robot are joined for articulate movement.

U.S. Pat. No. 4,248,006 issued to Jones, et al. sets forth a RECONFIGURABLE MOVING ANIMAL SIMULATING TOY having an upper and lower body section. The lower body section is operatively attachable to the upper body section in a plurality of configurations. A container capable of holding a liquid is included in the upper body section and a compressible bellows and nozzle are operatively connected to the container facilitating the squirting of liquid from the toy.

U.S. Pat. No. 4,307,533 issued to Sims, et al. sets forth an INSECT SIMULATING MOBILE TOY HAVING FLAPPABLE WINGS in which a main body section forming a head and tail section are attached to form an insect body. Two wings are rotatably mounted for disposition on both lateral sides of the main body section. A mechanism is provided to cause simultaneous flapping of all wings.

U.S. Pat. No. 4,529,391 issued to Hoshino, et al. sets forth a TOY HAVING TWO MODES OF LOCOMOTION including a body having a flywheel rotatably mounted therein. A further wheel is also rotatably mounted on the body and a plurality of appendages are mounted upon the body which may be configured alternatively to form a motorcycle or a dinosaur-like creature.

U.S. Pat. No. 4,578,046 issued to Ohno sets forth a REVERSIBLY TRANSFORMABLE TOY BLOCK ASSEMBLY constructed to be reversibly transformed between two entirely different toy types. The block assembly may be constructed to reversibly transform between a toy vehicle or a robot.

U.S. Pat. No. 4,586,911 issued to Murakami sets forth a TRANSFORMABLE TOY VEHICLE capable of being converted to a toy robot.

U.S. Pat. No. 4,680,018 issued to Ohno sets forth a RECONFIGURABLE TOY ASSEMBLY adapted to be reversibly transformed to provide to toy configurations distinct from each other. In its typical form, the reconfigurable toy is constructed to provide a vehicle and a humanoid form.

U.S. Pat. No. 5,052,680 issued to Malewicki, et al. sets forth a TRAILERABLE ROBOT FOR CRUSHING VEHICLES having a mechanical robot including hydraulically operated arms, mandible claws, neck, head and jaw resembling a giant prehistoric reptile. The mechanical robot may be reconfigured to form a trailer-like vehicle.

British Patent 2,153,242A issued to Ohno sets forth a RECONFIGURABLE TOY capable of configuration in a dinosaur form or a robotic humanoid.

British Patent 2,155,346A issued to Ohno sets forth a RECONFIGURABLE TOY AND MECHANISM THEREFOR having a plurality of interconnected members capable of configuration as a reptilian dinosaur-like monster or robot.

Examples of toys and toy vehicle like toys having feature components are found for example in U.S. Pat. No. 4,689,034 issued to Dubois, et al. which sets forth a FIGURE TOY WITH PROJECTILE LAUNCHING MECHANISM; U.S. Pat. No. 4,469,327 issued to Ulrich, et al. which sets forth an AMUSEMENT GAME DEVICE; 4,515,571 issued to Kozuka, et al. which sets forth a MOVING TOY CAPABLE OF BEING NONPERMANENTLY ASSEMBLED; U.S. Pat. No. 4,594,071 issued to Zaruba, et al. which sets forth a COMPOSITE TOY VEHICLE ASSEMBLY; U.S. Pat. No. 4,629,440 issued to McKittrick, Jr. et al. which sets forth an ANIMATED TOY; and U.S. Pat. No. 4,575,349 issued to Piazza, et al. which sets forth a WINGED CREATURE.

Further examples are found in the art which employ additional toy features such as U.S. Pat. No. 4,689,033 issued to Droller, et al. which sets forth a FIGURE TOY WITH RAPIDLY EXTENSIBLE TONGUE having an insect-like creature with a spring-loaded extending tongue; U.S. Pat. No. 4,682,970 issued to Dubois, et al. which sets forth a FIGURE TOY WITH EXTENSIBLE HEAD PORTION having an insect-like body supporting a spring-loaded extensible head and trigger mechanism; and U.S. Pat. No. 4,576,586 issued to Amici, et al. which sets forth a CORD-CLIMBING CREATURE having an insect-like body through which an elongated cord extends together with a pulley apparatus for climbing the cord.

U.S. Pat. No. 4,169,336 issued to Kuhn sets forth an STRETCHABLE FIGURE EXHIBITING SLOW RECOVERY having a skin of elastic film and a filling of a high viscosity material formed in a human like body which exhibits great elongation and slow recovery from stretching.

While the foregoing described prior art devices have, in many instances, improved the art and in some cases enjoyed substantial commercial success, there remains nonetheless a continuing need in the art for evermore improved toy vehicles having interesting configuration variations.

SUMMARY OF THE INVENTION

Accordingly, it is a general object of the present invention to provide an improved more interesting toy vehicle. It is a more particular object of the present invention to provide an improved more interesting toy vehicle having a simple actuating mechanism which dramatically alters the toy vehicle appearance and character. It is a still more particular object of the present invention to provide an improved toy vehicle in which the altered appearance and character provides a fanciful monster-like attack vehicle.

In accordance with the present invention, there is provided a toy vehicle comprising: a rear body; an actuator slidably supported by the rear body portion; a front body formed of at least two pivotally coupled portions; gear drive means coupled between the front body and the actuator operative to move the front body forwardly from the rear body as the actuator is moved with respect to the rear body; and a resilient membrane having a first end coupled to the rear body and a second end coupled to the front body, the resilient membrane being stretched between the front and rear body portions when the front body is moved forwardly.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
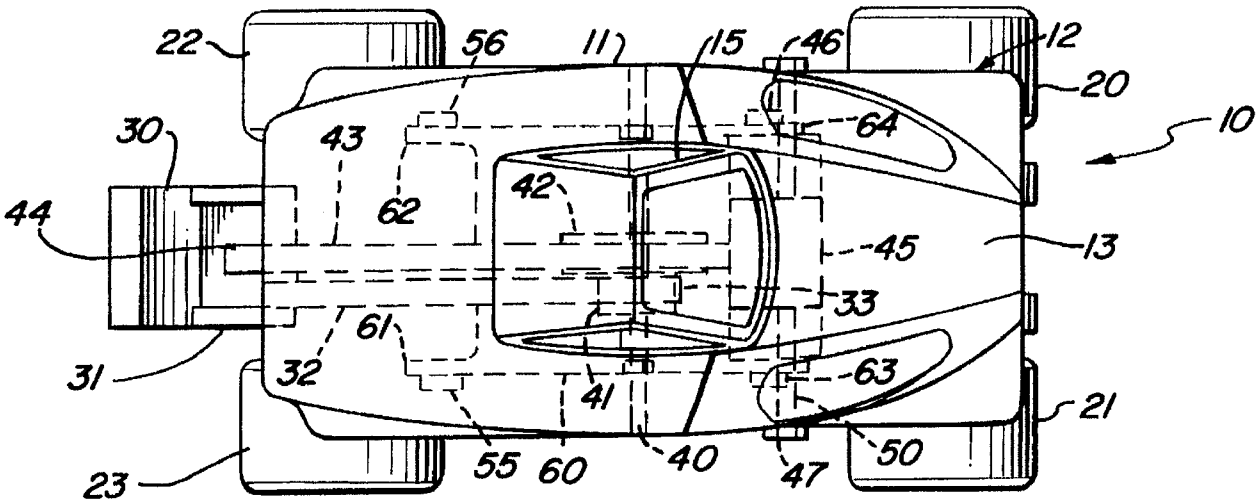
FIG. 1 sets forth a top view of a toy vehicle constructed in accordance with the present invention in its compacted configuration.
Figure 2:
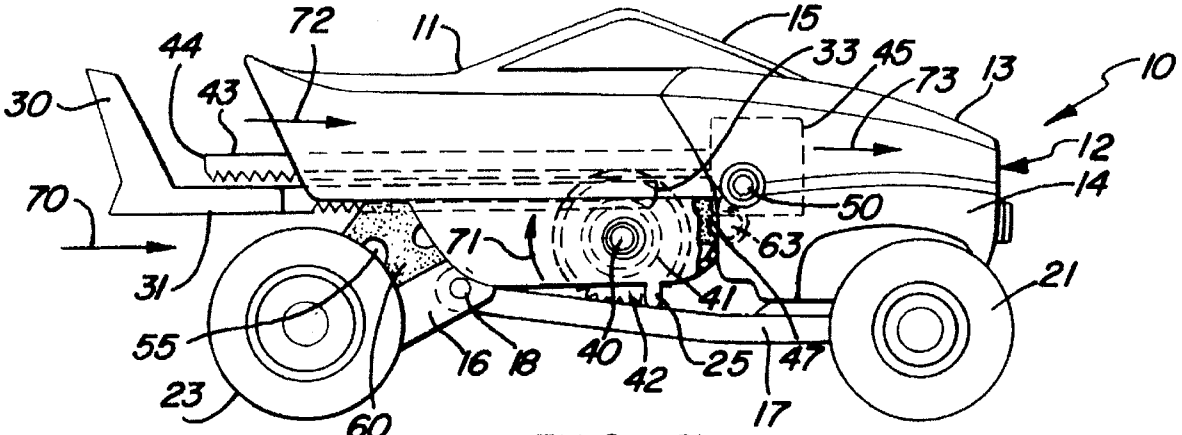
FIG. 2 sets forth a side elevation view of the present invention toy vehicle in the compacted configuration of FIG. 1.

FIG. 1 sets forth a top view of a toy vehicle constructed in accordance with the present invention and generally referenced by numeral 10. Toy vehicle 10 is shown in FIGS. 1 and 2 in the compacted configuration in which toy vehicle 10 generally resembles a somewhat fanciful performance toy vehicle. More specifically, toy vehicle 10 includes a rear body 11 and a front portion 12. As is better seen in FIG. 2, front body portion 12 includes an upper hood 13 and a lower portion 14. Toy vehicle 10 includes a set of rolling wheels 20 through 22 supported at the front and rear of the toy vehicle in accordance with conventional fabrication techniques (not shown). Rear body 11 further includes an upwardly extending simulated driver's cockpit 15. A transversely extending coupling member 45 is positioned beneath hood 13 above lower portion 14 (seen in FIG. 1) within front body portion 12. An elongated shaft 50 extends through apertures (not shown) formed in hood 13 and lower portion 14 to provide pivotal attachment of hood 13 and lower portion 14 to coupling member 45. Coupling member 45 further includes a rearwardly extending elongated gear rack 43 having a free end 44 extending beyond rear body 11. As is better seen in FIG. 2, gear rack 43 defines a plurality of downwardly extending gear teeth. A shaft 40 is supported by conventional means (not shown) and extends transversely through rear body 11 beneath gear rack 43. A compound gear comprised of a larger diameter gear 42 and a smaller diameter gear 41 preferably formed as an integral gear combination is rotatable upon shaft 40. Gear 42 engages the downwardly extending teeth of gear rack 43 in the manner shown in FIGS. 2 and 3 below.

Toy vehicle 10 further includes a rear spoiler 30 having a forwardly extending spoiler support 31 which in turn is coupled to a forwardly extending gear rack 32. Gear rack 32 defines a plurality of downwardly extending gear teeth (seen in FIG. 2) and a free end 33. Gear rack 32 is supported at a lower position than gear rack 43 allowing gear rack 32 to engage smaller diameter gear 41. While not shown in FIG. 1, it should be understood by those skilled in the art that appropriate channel enclosures are formed within rear body 11 to provide sliding support of gear racks 43 and 32.

As is better seen in FIG. 2, toy vehicle 10 further includes a rear chassis 16 extending beneath rear body portion 11. Returning to FIG. 1, rear chassis 16 includes a pair of outwardly extending attachment posts 55 and 56. Correspondingly and in accordance with an important aspect of the present invention, coupling member 45 includes a pair of outwardly extending attachment posts 46 and 47. In further accordance with an important aspect of the present invention and as is better seen in FIG. 3 below, toy vehicle 10 includes an elongated resilient membrane 60 having end portions 61 and 62 secured to attachment posts 55 and 56 and end portions 63 and 64 secured to attachment posts 47 and 46 respectively. Resilient member 60 is preferably formed of a thin sheet of resilient material such as plastic or rubber and, as is better seen in FIG. 3, defines a plurality of apertures formed therein. In its preferred form, resilient member 60 forms a cross-section having an inverted generally U-shaped configuration.

FIG. 2 sets forth a partially sectioned side view of toy vehicle 10 in the compacted configuration of FIG. 1. As described above, toy vehicle 10 includes a rear body 11 supporting a downwardly extending rear chassis 16. Rear body 11 further defines a simulated driver cockpit 15. Toy vehicle 10 further includes a front body portion 12 formed of a hood 13 and a lower portion 14. Hood 13 and lower portion 14 are pivotally secured to a coupling member 45 by an elongated shaft 50. Coupling member 45 includes a rearwardly extending gear rack 43 having a free end 44 extending beyond rear body 11. As mentioned above, gear rack 43 is slidably supported within an interior channel formed within rear body 11 by conventional means (not shown). Gear rack 43 further defines a plurality of downwardly extending gear teeth. As is also described above, coupling member 45 includes a pair of attachments 46 and 47 (the former shown in FIG. 1) which secure ends 64 and 63 (the former seen in FIG. 1) of resilient member 60. Similarly, a pair of attachment posts 55 and 56 (the latter seen in FIG. 1) extending from rear chassis 16 secure ends 61 and 62 (the latter seen in FIG. 1) of resilient membrane 60.

Toy vehicle 10 further includes a front chassis 17 supporting wheels 20 and 21 (the former seen in FIG. 1) which is pivotally coupled to rear chassis 16 by a pivot 18. Rear body 11 defines a downwardly extending stop 25 which limits the upward travel motion of front chassis 17 when the weight of vehicle 10 is resting upon the vehicle wheels. A rear spoiler 30 includes a forwardly extending spoiler support 31 having a gear rack 32 extending forwardly therefrom. Gear rack 32 is slidably supported within rear body 11 by conventional means (not shown) and defines a plurality of downwardly extending gear teeth and a free end 33. A cylindrical shaft 40 extends through rear body 11 and supports a pair of gears 41 and 42 in a rotatable attachment. Gear 42 defines a larger diameter and engages the gear teeth of gear rack 43 while gear 41 defines a smaller diameter and engages the gear teeth of gear rack 32. To accommodate the difference in diameter between gears 41 and 42, the positions of gear racks 32 and 43 are offset vertically and horizontally as seen in FIGS. 1 and 2.

Thus, in the compacted configuration of the present invention toy vehicle shown in FIG. 2, resilient membrane 60 is generally enclosed by rear body 11 and front body portion 12. Also, in the compacted configuration, front chassis 17 rests against stop 25 and lower portion 14 and hood 13 of front body portion 12 are pivoted to the closed position shown. As a result, toy vehicle 10 may be utilized in a conventional play pattern in which it is rolled about a convenient play surface. The resilience of resilient member 60 provides a spring force urging coupling member 45 against rear body 11 and maintaining the compacted position shown.

In accordance with an important aspect of the present invention, however, the appearance and configuration of toy vehicle 10 may be dramatically altered by the child user in grasping rear body 11 and rear spoiler 30 and forcing rear spoiler 30 forwardly in the direction indicated by arrow 70. This force overcomes the resilience force of membrane 60 and allows spoiler support 31 and gear rack 32 to move within rear body 11 in the direction of arrow 70. The engagement of gear rack 32 and smaller diameter gear 41 causes the combination of gears 41 and 42 to rotate in the direction indicated by arrow 71. Since gears 41 and 42 are coupled together and preferably integrally formed, the rotation of gear 41 is also imparted to gear 42. As gear 42 rotates in the direction of arrow 71, the engagement of gear 42 to gear rack 43 causes gear rack 43 to be forced forwardly in the direction indicated by arrow 72 with respect to rear body 11. The forward motion of gear rack 43 in the direction of arrow 72 drives coupling member 45 forwardly with respect to rear body 11 in direction indicated by arrow 73. Because hood 13 and lower portion 14 are pivotally coupled to coupling member 45, they are both carried forwardly as coupling member 45 is driven from rear body 11. Concurrently, the attachment of resilient membrane 60 to rear chassis 16 and coupling member 45 causes resilient membrane 60 to be stretched and elongated as front body portion 12 is driven forwardly. As the child user continues to force rear spoiler 30 in the direction of arrow 70, the above-described action continues and front body portion 12 is moved away from rear body 11. It should be noted that the larger diameter of gear 42 and smaller diameter of gear 41 provides a distance multiplication between the sliding movement of gear rack 32 and gear rack 43 in which gear rack 43 moves substantially farther than gear rack 32. Thus, the relatively small travel distance available to rear spoiler 30 in moving from the position shown in FIG. 1 to the fully extended position shown in FIG. 3 is multiplied several times causing front body portion 12 to be extended forwardly a substantially greater distance for a more dramatic effect.

Figure 3:
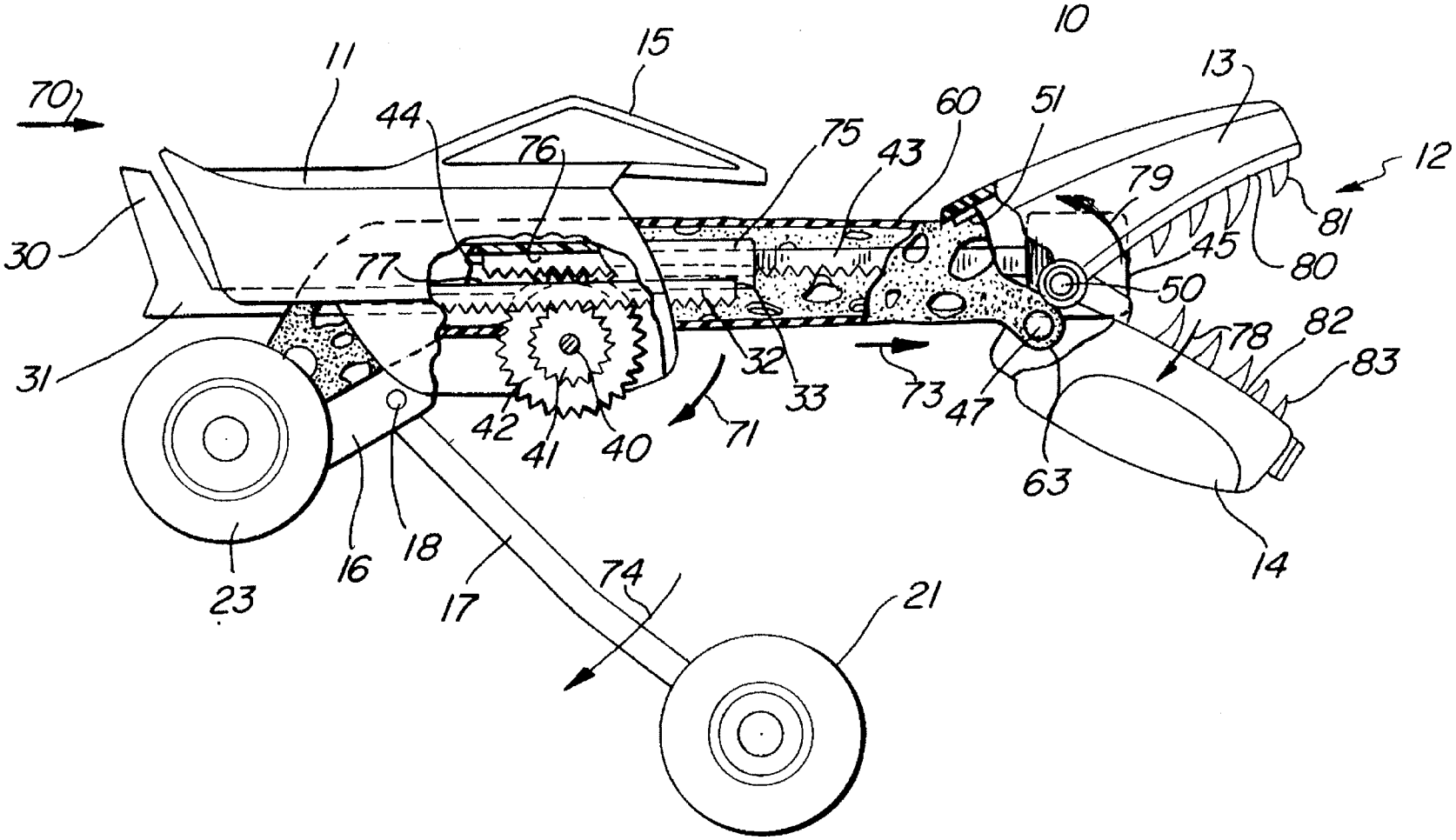
FIG. 3 sets forth a partially sectioned side elevation view of the present invention toy vehicle configured in its extended or attack position.

FIG. 3 sets forth a partially sectioned side view of toy vehicle 10 in its fully extended or attack position. Toy vehicle 10 includes a rear body 11 having a downwardly extending rear chassis 16 supporting a pair of rear wheels 22 and 23 (the former seen in FIG. 1). Rear body 11 further includes a cockpit 15 and supports a transversely extending shaft 40. Shaft 40 supports a pair of gears 41 and 42 in a rotatable attachment. Rear chassis 16 includes a pair of attachment posts 55 and 56 (the latter seen in FIG. 1) which secure the rear portion of a resilient membrane 60. Rear body 11 further defines an interior rack guide 75 having elongated rack channels 76 and 77 formed therein. Shaft 40 is positioned beneath channels 76 and 77 upon rear body 11. A rear spoiler 30 having a forwardly extending spoiler support 31 includes a gear rack 32 having a free end 33. Gear rack 32 is slidable within channel 77 and includes a plurality of downwardly extending gear teeth which engage gear 41. Conversely, a gear rack 43 is slidably received within channel 76 of guide 75 and includes a free end 44. The remaining end of gear rack 43 is coupled to a coupling member 45. Gear rack 43 defines a plurality of downwardly extending gear teeth which engage gear 42. Coupling member 45 includes a pair of attachments 46 and 47 (the former seen in FIG. 1) which secure end portions 64 and 63 (the former seen in FIG. 1) of resilient membrane 60. Toy vehicle 10 further includes a front body portion 12 formed of a hood 13 and a lower portion 14. A shaft 50 extends through coupling member 45 and pivotally supports hood 13 and lower portion 14. An attachment 51 secures the top frontal portion of resilient membrane 60 to the underside of hood 13. In accordance with the present invention, hood 13 defines an upper jaw 80 having a plurality of simulated downwardly extending teeth 81. Similarly, lower portion 14 defines a lower jaw 82 having a plurality of upwardly extending teeth 83. With temporary reference to FIG. 2, it should be noted that upper jaw 80 and lower jaw 81 are configured to permit closure thereof in the compacted position shown in FIG. 2. A resilient membrane 60 preferably formed of a flexible rubber or plastic material is stretched between attachment posts 55 and 56 of rear chassis 16 and coupling member 45 as well as hood 13. In its preferred form, membrane 60 defines a plurality of apertures which elongate during the stretching process as toy vehicle 10 is moved to the extended or attack position shown in FIG. 3 adding an interesting visual effect to membrane 60. Front chassis 17 supports front wheels 20 and 21 (the former seen in FIG. 1) in a pivotal attachment at a pivot 18 secured to rear chassis 16.

In operation as the child user forces spoiler 30 against rear body 11 in the direction indicated by arrow 70, gear rack 32 is driven forwardly causing gear 41 to be rotated about shaft 40 in the direction indicated by arrow 71. The common attachment of gears 41 and 42 causes gear 42 to be correspondingly rotated as gear rack 32 is driven forwardly. The gear coupling between gear 42 and gear rack 43 causes gear rack 43 to be driven forwardly in the direction indicated by arrow 73. The forward motion of gear rack 43 drives coupling member 45 in a corresponding forward motion carrying hood 13 and lower portion away from rear body 11. At the same time, resilient membrane 60 is stretched and deformed due to the attachment of ends 63 and 64 thereof to coupling member 45. In addition, as lower portion 14 is moved beyond front chassis 17, the weight of lower portion 14 causes it to pivot downwardly about shaft 50 in the direction indicated by arrow 78 opening and exposing lower jaw 82 and teeth 83. Concurrently, the resilient character of membrane 60 produces a resisting force against the extension of gear rack 43 and the forward motion of coupling member 45. This resilient force is communicated to the upper rear edge of hood portion 13 due to attachment 51 along the top portion of membrane 60. This resilient force produces pivoting motion of hood 13 about shaft 50 in the direction indicated by arrow 79 opening upper jaw 80 and exposing it together with teeth 81. Thus, in the extended position shown, front body portion 12 assumes the open mouth attack configuration of the toy vehicle. Upon release of rear spoiler, the resilient force of membrane 60 draws coupling member 45 back toward rear body 11 and returns toy vehicle 10 to the compacted position shown in FIGS. 1 and 2.

It should be noted that the pivotal attachment of front chassis 17 facilitates operation of the present invention toy vehicle in either of two attack postures. In the position shown in FIG. 3, toy vehicle 10 has been raised from the support surface allowing front chassis 17 to pivot downwardly in the direction indicated by arrow 74 allowing the front chassis to assume an open position while maintaining rear body 11 and the remainder of toy vehicle 10 in a generally horizontal orientation as rear wheels 22 and 23 (the former seen in FIG. 1) are raised from the play surface. Conversely, however, the child user may alternatively maintain the vehicle wheels upon the support surface and pivot rear body 11 and the remainder of toy vehicle 10 upwardly at an acute angle to the play surface in which the vehicle wheels are maintained upon the play surface while the remainder of the vehicles is pivoted upwardly. This changes the appearance and character somewhat as the open mouth or open jaw portion of the toy vehicle is extended upwardly at an acute angle. Of course, different angles of inclination may be achieved in this utilization due to the pivotal action of front chassis 17.

In accordance with an important aspect of the present invention, resilient membrane 60 provides a novel monster-like image enhancement as it is stretched during the forward extension and movement of hood 13 and lower portion 14. Further, the resilient character of membrane 60 and the plurality of apertures formed therein combine to allow the apertures to elongate as membrane 60 is stretched. This provides an unusual and interesting visual effect for the toy vehicle. In its preferred form, membrane 60 is generally U-shaped in cross-section and inverted to provide a covering top surface and downwardly extending side surfaces to partially enclose gear racks 43 and 32 while maintaining the desired appearance. Alternatively, however, it will be apparent to those skilled in the art that differently shaped membranes may be utilized in the present invention without departing from the spirit and scope of the invention in its broader aspects. For example, membrane 60 may be formed with a plurality of folded segments such as a conventional bellows or the like or further may be fabricated using a plurality of elongated strip segments without departing from the invention.

With the toy vehicle in the attack position shown in FIG. 3, the vehicle is easily returned to the compacted position shown in FIGS. 1 and 2 by releasing rear spoiler 30. As rear spoiler 30 is released, the resilient force of member 60 urges coupling member 45 rearwardly toward rear body 11 drawing hood 13 and lower portion 14 against rear body 11 in the position shown in FIG. 2. The rearward motion of gear rack 43 during the drawing process causes a rotation of gears 42 and 41 in the opposite direction to arrows 71 which in turns drives gear rack 32 and spoiler 30 rearwardly to the position shown in FIG. 2. Thereafter, the weight of toy vehicle 10 is rested upon the vehicle wheels causing front chassis 17 to be pivoted upwardly beneath lower portion 14 closing lower jaw 82. Concurrently, the relaxation of the resilient force of membrane 60 allows hood 13 to pivot downwardly. As a result, the toy vehicle reassumes the closed or compacted configuration shown in FIG. 2.

What has been shown is a novel toy vehicle having a pair of concealed extendable jaws together with an image enhancing membrane which is stretched and exposed as the vehicle jaws are extended. The entire configuration of extended jaws is achieved through a simple gear rack and gear drive mechanism coupled to a movable rear spoiler. The entire vehicle is readily fabricated of simple mass produced molded plastic components or the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle comprising:

a rear body;

an actuator slidably supported by said rear body portion;

a front body formed of at least two pivotally coupled portions;

gear drive means coupled between said front body and said actuator operative to move said front body forwardly from said rear body as said actuator is moved with respect to said rear body; and a resilient membrane defining a plurality of apertures and having a first end coupled to said rear body and a second end coupled to said front body, said resilient membrane being stretched between said front and rear body portions when said front body is moved forwardly to elongate said plurality of apertures as said membrane is stretched.

2. A toy vehicle comprising:

a rear body;

an actuator slidably supported by said rear body portion;

a front body formed of at least two pivotally coupled portions;

gear drive means coupled between said front body and said actuator operative to move said front body forwardly from said rear body as said actuator is moved with respect to said rear body; and a resilient membrane having a first end coupled to said rear body and a second end coupled to said front body, said resilient membrane being stretched between said front and rear body portions when said front body is moved forwardly, wherein said gear drive means includes:

a first gear rack coupled to said actuator;

a second gear rack coupled to said front body; and gear means for rotationally engaging said first and second gear racks.

3. A toy vehicle as set forth in claim 2 wherein said gear means includes a pair of gears defining different diameters.

4. A toy vehicle as set forth in claim 3 wherein said at least two pivotally coupled portions includes an upper jaw and a lower jaw.

5. A toy vehicle as set forth in claim 4 wherein said resilient member is formed of a thin sheet of resilient material.

6. A toy vehicle as set forth in claim 5 wherein said thin sheet defines a plurality of apertures which elongate as said membrane is stretched.

7. A toy vehicle as set forth in claim 6 wherein said resilient membrane is coupled to one of said two pivotally coupled portions of said front body to pivot it away from the remaining one of said two pivotally coupled portions as said membrane is stretched.

8. A toy vehicle as set forth in claim 1 wherein said at least two pivotally coupled portions includes an upper jaw and a lower jaw.

9. A toy vehicle as set forth in claim 8 wherein said resilient member is formed of a thin sheet of resilient material.

10. A toy vehicle as set forth in claim 9 wherein said resilient membrane is coupled to one of said two pivotally coupled portions of said front body to pivot it away from the remaining one of said two pivotally coupled portions as said membrane is stretched.

11. A toy vehicle comprising:

a rear body;

an actuator slidably supported by said rear body;

a front body having a hood defining an upper jaw and a lower portion defining a lower jaw, said hood and lower portion being pivotable between an open jaw and a closed jaw position;

drive means coupled between said actuator and said front body responsive to movement of said actuator with respect to said rear body to extend said front body forwardly from said rear body; and a resilient membrane coupled between said rear body and said front body, said membrane including a thin sheet of resilient material formed to define an inverted U-shape cross-section being stretched therebetween when said front body is extended forwardly.

12. A toy vehicle as set forth in claim 11 wherein said actuator includes a rear spoiler.

13. A toy vehicle as set forth in claim 12 wherein said rear body includes a rear chassis and a pair of rear wheels and a front chassis pivotally coupled to said rear chassis having a pair of front wheels.

14. A toy vehicle as set forth in claim 11 wherein said thin sheet defines a plurality of apertures therein.

* * * * *